United States Patent [19]

Fairbairn

[11] 4,272,150

[45] Jun. 9, 1981

[54] ELECTRICAL CONTACT FOR AN ELECTRICAL CONNECTOR

[75] Inventor: LeRoy W. Fairbairn, Sidney, N.Y.

[73] Assignee: The Bendix Corporation, Southfield, Mich.

[21] Appl. No.: 78,255

[22] Filed: Sep. 24, 1979

[51] Int. Cl.[3] ..... H01R 11/00

[52] U.S. Cl. ..... 339/276 T

[58] Field of Search ..... 339/47 R, 248 R, 276 R, 339/276 T, 275 R, 275 T; 174/84 R

[56] References Cited

U.S. PATENT DOCUMENTS

| | | | |
|---|---|---|---|
| 2,226,849 | 12/1940 | Douglas | 339/276 R |
| 2,259,261 | 10/1941 | Miller et al. | 339/276 R |
| 2,774,810 | 12/1956 | Ritter | 339/276 R |
| 3,626,363 | 12/1971 | McIver | 339/276 R |
| 3,725,844 | 4/1973 | McKeown et al. | 339/108 TP |
| 4,184,736 | 1/1980 | Spaulding | 339/276 T |

FOREIGN PATENT DOCUMENTS

| | | | |
|---|---|---|---|
| 637564 | 3/1962 | Canada | 339/276 R |

*Primary Examiner*—Neil Abrams

*Attorney, Agent, or Firm*—Kenneth A. Seaman; David R. Syrowik; C. Dennis Lacina

[57] ABSTRACT

An improved electrical contact (10) for an electrical connector is disclosed. A first version of the contact comprises an elongated deep-drawn holder (11) having an axial holder passage (14) and an enlarged shoulder (12). The contact also includes a plurality of axially aligned electrical conducting fine wires (50) assembled together in a brush wire bundle. An elongated deep-drawn sleeve member (40) having an axial passage (46) extending therethrough is positioned over the holder to transform the first version into a second version of the contact. An intermediate flange (20) of the holder disposed rearward the shoulder is bent radially inwardly from the inner surface (22) of the holder passage to a position immediately adjacent the opposite inner surface (24) of the holder passage to provide an aperture (30) rearward the flange. The wire bundle, the sleeve and the holder are crimped together at a position forward the shoulder by four dies (64, 66, 68, 70) spaced apart in a circular arrangement.

2 Claims, 6 Drawing Figures

ELECTRICAL CONTACT FOR AN ELECTRICAL CONNECTOR

TECHNICAL FIELD

This invention relates generally to electrical connectors and particularly electrical connectors of the type having what is sometimes referred to as "brush wire contacts".

BACKGROUND ART

Prior patents disclose brush wire contact devices having a single housing with a machined shoulder and machined axial passages for receiving an electrical conductor and for receiving a plurality of fine wires having tapered or angled surfaces at their ends. Such wires are referred to as "brush wires". See, for example, U.S. Pat. No. of McKeown et al. 3,725,844 issued Apr. 3, 1973, the entire disclosure of which is incorporated herein by reference.

Brush wire contact components are generally machined from metal stock, and because of their small size the contacts are machined to a tolerance of 0.002 inches or less. A contact which is oversized for any reason cannot be utilized because it may not be possible to insert such a contact into the contact receiving holes of a connector insert for insufficient clearance between adjacent contacts may cause electrical or mechanical problems.

Machining of electrical contacts is expensive and because of the large number of small contacts utilized by a particular electrical connector the connector is expensive. Typically the brush wires, arranged in bundles, are mechanically secured in a machined holder or similar component by crimping. One way to reduce the cost of manufacturing the connector is to form the contact holder and the other components by stamping and rolling them from a sheet of metal. U.S. Pat. No. of Waldron et al. 4,072,394 issued Feb. 7, 1978, the entire disclosure of which is hereby incorporated herein by reference, disclosed a three-piece electrical contact assembly which includes an inner sleeve and first and second outer sleeves telescopically located over the front and rear portions of the inner sleeve. The inner sleeve is adapted to receive a male pin-type electrical contact by spring fingers which form the front portion of the socket contact.

Generally each of the contacts within a connector assembly is removable so that it may be connected, for example, by crimping to an incoming wire when electronic equipment is installed. Ordinarily each of the incoming wires to the connector is attached to its respective contact by inserting the electrical wire into an axial opening, machined at one end of the contact, and by crimping the contact to the wire to obtain an electrical or mechanical connection. The crimping operation is performed by a plier type tool that, when squeezed, applies pressure simultaneously to two pairs of diametrically opposed points in the circumference of the contact to deform the contact into the wire in the contact. After the crimping operation each of the contacts is inserted into the connector assembly where they are retained therein in a conventional fashion.

DISCLOSURE OF THE INVENTION

An object of the present invention is to provide a two-piece electrical contact particularly of the brush wire type, which is simple in construction and economical to manufacture.

Another object is to provide an electrical contact, particularly of the brush wire type wherein the components for holding and receiving brush wires, conductors, and the like, are formed from tube stock.

A further object is to provide an improved two-piece contact construction, particularly suited for a brush wire type contact, having a component drawn from tube stock with a bundle of wires axially positioned in a passage formed in the drawn component and wherein the two pieces and the wires are secured together.

It is also an object of this invention to provide an electrical contact construction, particularly suitable for contacts of the brush wire type, having an integral flange portion bent into the axial passage of a holder for receiving wires and conductors so as to provide a limit stop for the wires and conductors inserted into opposite ends of the holder.

Another object is to provide an electrical contact construction, particularly suitable for the brush wire type, that can be fabricated easily in large quantities and at low cost.

Another object is to provide a contact holder construction particularly suitable for use in brush wire type contacts that can be interchangeably utilized in more than one type of brush contact construction.

In carrying out the foregoing and other objects, a preferred embodiment of the invention includes a holder (11) having an axial passage (14) and including forward and rear portions (16) and (18). The forward portion (16) is adapted for receiving several axially aligned electrical conducting wires (50), such as a brush wire bundle, within the passage for mating in electrical curcuit relationship with a similar contact. The rear portion (18) is adapted for receiving and securing thereto an insulated electrical conductor. The holder connects the wires and the conductor in electrical circuit relationship. The holder includes a flange (20) located medially the holder ends (32, 36) from an inner surface (22) on one side of the holder across the holder passage to a position immediately adjacent the inner surface (24) on the opposite surface (22) of the holder. The flange provides a limit stop for a bundle of brush wires and a conductor inserted into opposite ends of the holder. An aperture (30) is formed in the wall of the holder and extends into the rear portion of the holder passage immediately rearwardly of the flange whereby a portion of the conductor held in the rear portion may be inspected through the aperture from outside of the holder.

The holder (11) disclosed herein also is formed with a shoulder (12) which is expanded radially outwardly from the tubular stock of the holder and is located on the forward portion of the holder passage near the flange (20).

A preferred method for making an electrical contact according to the invention comprises the steps of bending an intermediate flange of the holder rearward the shoulder portion radially inwardly from the inner surface of the holder passage to a position immediately adjacent the opposite inner surface of the holder passage to divide the holder passage into a front portion and a rear portion. The method further includes the steps of inserting the wires into the forward end of the axial passage until the inserted ends of the wires engage the bent flange, sliding the sleeve over the holder until the sleeve engages a shoulder of the holder and securing the wires and the sleeve and the holder together at a position forward the shoulder.

The objects, features and advantages of the present invention are readily apparent from the following detailed description of the best mode taken in connection with the accompanying drawings.

BEST MODE FOR CARRYING OUT THE INVENTION

Figure 4:
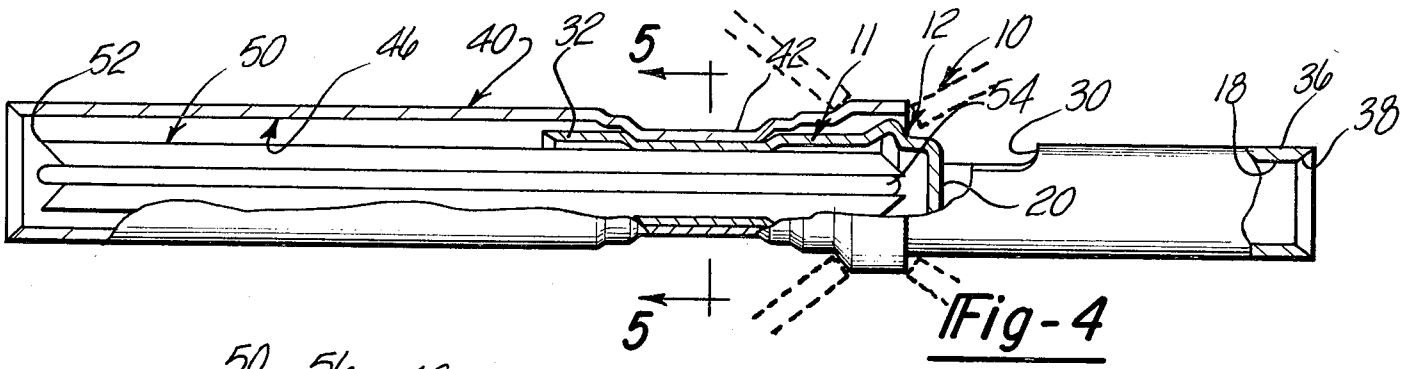
FIG. 4 is an elevational view partially in section, of an electrical contact assembly constructed according to this invention.

With reference to the drawings, an electrical contact assembly is collectively designated by reference numeral 10 in FIG. 4. The contact assembly 10 includes a holder 11 for a bundle of brush wires 50, and a sleeve member 40 which coaxially receives the holder 11.

Figure 1:
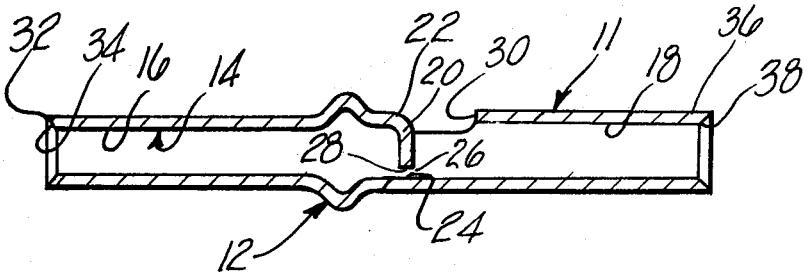
FIG. 1 is a sectional view of a contact holder constructed according to this invention.

As shown in FIG. 1, the holder 11 is deepdrawn from metal stock. An example of one preferred material for the holder 11 is beryllium copper which is formed to have a wall thickness of about 0.007 inches. The metal stock from which the holder 11 is formed may be plated or the holder 11 may be plated after the forming operation with tin, silver, or gold plating thereon to provide the holder 11 with good electrical current-carrying characteristics.

The holder 11 is formed with an enlarged shoulder generally indicated at 12 which allows the holder 11 to be held within a dielectric insert shown generally by phantom lines in FIG. 4. Such dielectric inserts are shown in the U.S. Pat. Nos. to Bourdon et al 4,082,398 and Bourdon et al 4,157,806, the entire disclosures of which are incorporated herein by reference. The holder 11 is preferably retained within the passage of such dielectric inserts having therein opposing, radially deflectable, contact retaining fingers integral with the insert. The radially deflectable fingers allow the holder 11 to be inserted and removed from one end of an electrical connector of which the dielectric insert is a part.

Figure 2:
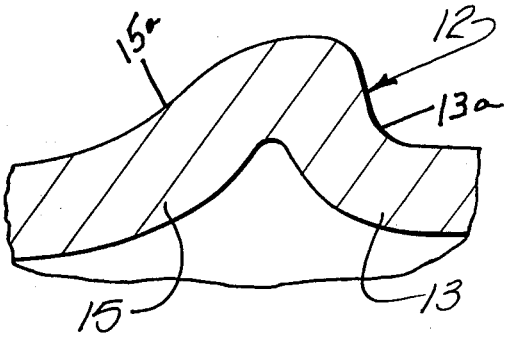
FIG. 2 is an enlarged fragmentary sectional view of the holder of FIG. 1.

Referring to FIG. 2, the shoulder 12 is formed by pulling the flat metal stock between suitably formed and spaced dies. The shoulder portion 12 includes a sharply curved portion 13 having a relatively small radius of curvature 13*a* integrally formed with a gradually curving portion 15 having a relatively large radius of curvature 15*a* to form the sides of the shoulder 12 which, in turn, are engaged by the retaining fingers of an insert.

The holder 11 is formed with an axial passage generally indicated at 14 including a front passage portion 16 and a rear passage portion 18 on opposite sides of a flange 20. As an example, in one specific contact made according to the invention, the diameter of the rear portion 18 is 0.0345 inches, while the diameter of the front portion 16 forwardly of the shoulder 12 is 0.030 inches. The diameter of the front portion 16 between the shoulder 12 and flange 20 is the same as the diameter of the rear portion 18 in the illustrated embodiment. As previously referred to, the front portion 16 of the passage 14 is separated from the rear portion 18 of the passage 14 by an integral intermediate flange 20 which extends radially inwardly from the upper inner surface 22 of the holder 11 to a position immediately adjacent the opposite lower inner surface 24 of the holder 11. The space 26 between the lower surface 24 and the end portion 28 of the flange portion 20 is no larger than 0.005 inches and is preferably on the order of 0.002 inches to thereby provide a rear brush wire limit stop as is described in greater detail below.

Rearwardly of the shoulder 12 and immediately rearwardly the flange 20, an aperture 30 formed in the wall of the holder extends into the rear portion 18 of the passage 14 to allow one to inspect whether a conductor (not shown) is properly held by the holder 11 within the rear portion 18 as described in greater detail below.

The front end 32 of the holder 11 is rounded or chamfered about the front opening 34 of the passage 14 to allow for the easy insertion of wires, and the rear end 36 of the holder 11 is rounded or chamfered about the rear opening 38 of the passage 14 to allow for the easy insertion of the conductor as is described in greater detail below.

Figure 3:
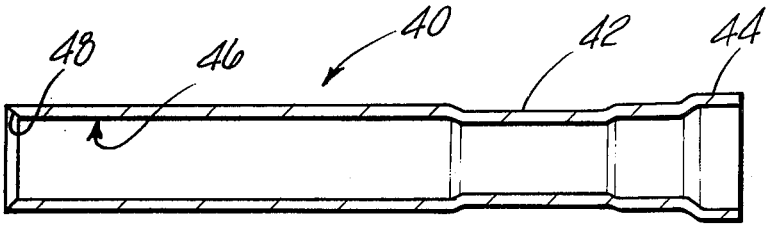
FIG. 3 is a sectional view of a sleeve constructed according to this invention.

The elongated electrically conducting sleeve 40 is illustrated in FIG. 3. The sleeve 40 is preferably formed from stainless steel tubular stock and is formed to have a reduced diameter neckdown portion 42 and an enlarged rear portion 44. The illustrated sleeve 40 is tubular and has an axial passage 46 that extends completely through the sleeve. The front opening of the passage 46 is rounded or chamfered 48 inwardly to facilitate the passage of wires (not shown) into the end portion of the passage 46.

As shown in FIG. 4, the sleeve 40 telescopically receives the front end 32 of the holder 11. Several axially aligned electrical conducting fine wires which comprise brush wires arranged in a bundle generally indicated at 50 are axially aligned within the front portion 16 of the holder passage 14 and within the sleeve passage 46. The wires 50 are straight and preferably made of beryllium copper with a diameter on the order of 0.008 inches. In the illustrated embodiment, the bundle of wires 50 comprise seven in number, however, a greater or lesser number of such wires could also be used. The forward and rear ends 52 and 54, respectively, of the wires 50 have acutely angled or tapered end surfaces preferably having a 30° included angle.

The wires 50 are inserted into the holder 11 until the rear ends 54 engage the flange 20 which serves as a rear limit stop for the wires 50. The opening 26 between the end portion 28 of the flange 20 and the opposite inner surface 24 is too small to allow the passage of any one of the wires 50. Furthermore, the diameter of the front portion 16 of the passage 14 immediately rearward the shoulder 12 is larger than the diameter of the front portion 16 of the passage 14 immediately forward the shoulder 12 to prevent the inserted rear ends 54 of the straight wires 50 from being lodged within the space 26.

The contact 10 is adapted to have an electrical conductor mounted in the rear end 36 thereof. The conductor is inserted until the forward end of the conductor contacts the rear face of the flange 20 and is then secured in place within the holder 11 by crimping.

The electrical contact 10 may be considered a "female" version of the contact and two similar contacts of different size may be used as a mateable pair in some applications. In other applications it is desirable to have a "male" contact and a "female" contact. If the sleeve 40 of the contact 10 were removed, a "male" version of the contact would be formed. The contact 10 shown in FIG. 4 is considered a "female" contact since a cross-sectional area of the axial passage 46 provides a space between the wires 50 and the inner wall of the sleeve 40 which defines the passage 46 for the spreading of the wires 50 in a radial direction when the wires of a similar assembly (not shown) are mated within the sleeve 40. Further, the sleeve 40 provides a protective shield around the wires 50 to protect them during insertion and use to protect an electrical connector housing when the contact is inserted and used therein.

Figure 5:
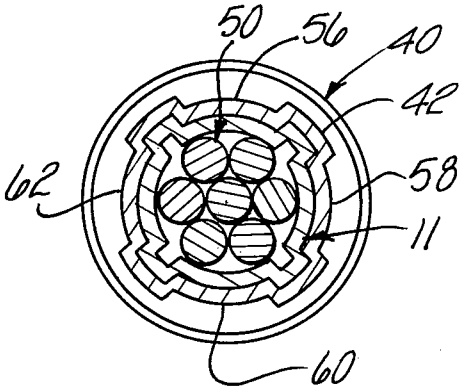
FIG. 5 is a cross-sectional view taken along lines 5—5 of FIG. 4, slightly enlarged for illustrative purposes.
Figure 6:
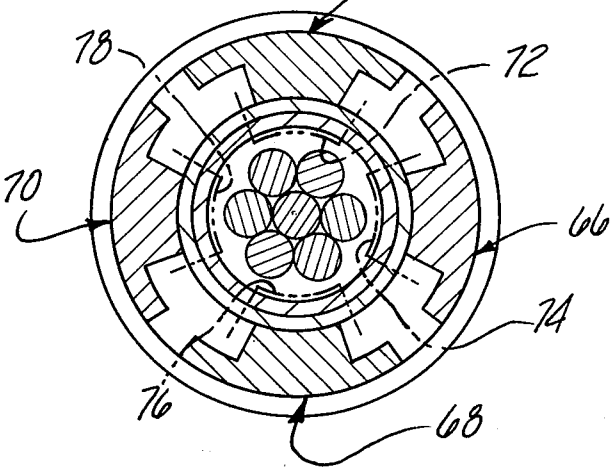
FIG. 6 is a view similar to FIG. 5 illustrating a step in the method of forming the contact.

As shown in FIG. 4, the sleeve 40 is secured to the holder 11 and the wires 50 are secured to the holder 11 by a plurality of radially extending crimps, preferably four in number, at four crimping positions 56, 58, 60 and 62 as shown in FIG. 5. As shown in FIGS. 5 and 6, the crimping positions are circumferentially spaced about the neckdown portion 42 of the sleeve 40 forward the shoulder portion 12.

FIGS. 1, 4 and 6 illustrate the steps associated with the forming of the contact holder 11 and the contact 10.

FIG. 1 illustrates the formed configuration of the holder 11 having the integral flange portion 20 cut out and bent inward such as by stamping to provide a rear stop for the wires 50 and a forward stop for the conductor. Preferably, the flange 20 is formed after the entire holder 11 is plated. The aperture 30 is created by the removal of the flange portion 20 and serves as an inspection port or hole to ascertain that the conductor inserted from the rear end 38 of the holder 11 has been properly prepared and completely inserted.

FIGS. 4, 5 and 6 illustrate how the wires 50, the holder 11 and the sleeve 40 are secured together after the wires 50 are inserted into the forward end 32 of the axial passage 14 and the sleeve 40 is slid over the holder 11 up to the shoulder portion 12. The crimping operation is performed forward the shoulder portion 12, at the neckdown portion 42 by first positioning the assembled contact 10 at the center of four dies generally indicated at 64, 66, 68 and 70 and which have forming surfaces 72, 74, 76 and 78, respectively. The crimping is performed when the dies 64 through 70 are simultaneously moved radially inwardly against the neckdown portion 42 of the sleeve 40. Thereafter, the dies 64 through 70 are retracted radially outwardly and the finished "female" type contact 10 is removed. As can be readily appreciated, when such crimping is performed without the sleeve 40, a "male" type contact is formed.

Alternatively, the wires 50 may be first crimped within the holder 11 and then the sleeve 40 may be crimped to the holder 11 by using the same dies 64 through 70.

While a preferred embodiment of the contact and the method of making the contact has been shown and described herein in detail, those skilled in this art will recognize various alternative designs and embodiments for practicing the present invention as defined by the following claims.

What is claimed is:

1. A contact for an electrical connector, said contact comprising:

an elongated electrically conducting tubular holder having an axial passage extending completely therethrough, a flange projecting radially inwardly from the wall of the holder and located intermediate the ends thereof to define a forward portion and a rear portion, said flange having an inner end integral with the wall of said holder and a free end terminating on the opposite side of the longitudinal axis of said holder from said inner end to substantially close the axial passage in said holder, said flange defining a limit stop when a conductor is inserted into the rear portion of the holder, an aperture formed in the wall of the rear portion of said holder to permit inspection of a conductor inserted therein, and a shoulder projecting radially outwardly from the tubular wall of the forward portion of said holder;

a plurality of axially aligned wires disposed in the forward portion of the holder, each of said wires having a forward end portion projecting beyond the outer end of the forward portion of the holder, each forward end portion of said wire terminating in an acutely angled surface;

an elongated electrically conducting sleeve telescopically mounted to the forward portion of said holder; and four arcuate depressions concave towards the central axis of said holder and symmetrically located in said holder and sleeve between the shoulder and the forward end of said holder to retain said wires within said holder and retain said holder within said sleeve.

2. A contact for an electrical connector, said contact comprising:

an elongated electrically conducting tubular holder having an axial passage extending completely therethrough, a flange projecting radially inwardly from the wall of the holder and located intermediate the ends thereof to define a forward portion and a rear portion, said flange having an inner end integral with the wall of said holder and a free end terminating on the opposite side of the longitudinal axis of said holder from said inner end to substantially close the axial passage in said holder, said flange defining a limit stop when a conductor is inserted into the rear portion of the holder, and a shoulder projecting radially outwardly from the tubular wall of the forward portion of said holder;

a plurality of axially aligned wires disposed in the forward portion of the holder, each of said wires having a forward end portion projecting beyond the outer end of the forward portion of the holder, each forward end portion of said wire terminating in an acutely angled surface; and four symmetrically arranged arcuate crimps in said holder, and concave towards the central axis of said holder, said crimps located between the shoulder and the forward end of holder to retain said wires within said holder.

* * * * *